US006589598B2

(12) United States Patent
Ochiai et al.

(10) Patent No.: US 6,589,598 B2
(45) Date of Patent: Jul. 8, 2003

(54) METHOD AND AN APPARATUS FOR APPLYING A COATING ONTO A PLATE

(75) Inventors: Shinsuke Ochiai, Niihama (JP); Nissho Iwamoto, Yao (JP)

(73) Assignees: Sumitomo Chemical Company, Limited, Osaka (JP); Meihan Shinku Kogyo Company Limited, Nara (JP)

( * ) Notice: Subject to any disclaimer, the term of this patent is extended or adjusted under 35 U.S.C. 154(b) by 0 days.

(21) Appl. No.: 09/986,157

(22) Filed: Nov. 7, 2001

(65) Prior Publication Data

US 2002/0104479 A1 Aug. 8, 2002

(30) Foreign Application Priority Data

Nov. 15, 2000 (JP) ..... 2000-347769

(51) Int. Cl.[7] ..... B05D 1/28

(52) U.S. Cl. ..... 427/211; 427/359; 427/428; 118/114; 118/224; 118/227

(58) Field of Search ..... 427/211, 428, 427/359; 118/114, 224, 227

(56) References Cited

U.S. PATENT DOCUMENTS 4,493,857 A * 1/1985 Knigge et al. ..... 427/96
5,480,483 A * 1/1996 Velie ..... 118/45
6,344,087 B2 * 2/2002 Hein ..... 118/262

FOREIGN PATENT DOCUMENTS

JP 5-168999 7/1993

* cited by examiner

*Primary Examiner*—Katherine A. Bareford
(74) *Attorney, Agent, or Firm*—Sughrue Mion, PLLC

(57) ABSTRACT

The present invention provides a method for coating a plate with a coating solution comprising the steps of: holding the plate in such a manner that surfaces of the plate to be coated are aligned substantially parallel to a gravity direction; moving the plate in a direction parallel to the surfaces of the plate and at a right angle to the gravity direction; passing the plate between two coating rolls to which the coating solution is applied, which rolls rotate in the same direction as that of the plate while being in contact with the surfaces of the plate, and which rotation axes are substantially perpendicular to a moving direction of the plate and to normal direction of the surfaces of the plate; and forming a film of the coating solution on at least one surface of the plate.

3 Claims, 9 Drawing Sheets

METHOD AND AN APPARATUS FOR APPLYING A COATING ONTO A PLATE

BACKGROUND OF THE INVENTION

1. Technical Field of the Invention

The present invention relates to a method for coating a plate with a coating solution containing colorants or ingredients which will afford various functional characteristics such as scratch resistance, antistatic property, antireflection, stain proof, defogging property and light absorbency, so that a coated film with various functional, protective, colored, and design capabilities is formed. A suitable coating apparatus for carrying out the above method is provided as well.

2. Description of the Related Art

As a method for coating chemical solutions to surfaces of a plate, various coating techniques have been conventionally employed, such as dip coating, flow coating, curtain flow coating or roll coating.

However, none of these known methods are fully satisfactory from the viewpoint of productivity or precision of a coated film thickness. For example, a dip coating method allows simultaneous coating to both surfaces of a plate and achieves a high precision of a coated film thickness, but has a disadvantage of very slow coating speed. A curtain flow coating or roll coating method can obtain substantially even coated film thickness at a fast coating speed, but is less productive since a rear side of a plate must be evenly supported, which makes it difficult to coat the both surfaces at a time. Some arrangement can be made for coating both surfaces at a time, but even in this case the production efficiency is not satisfactory since supporting parts are inevitably left uncoated. Further, a flow coating method allows simultaneous coating under a simple operation, but has a disadvantage of inferior precision of a coated film thickness.

SUMMARY OF THE INVENTION

In view of the foregoing disadvantage incidental to the prior arts, present inventors studied to develop a productive coating method that provides substantially even thickness of a coated film and allows quick and simultaneous coating to both surfaces of a plate, and an appropriate coating apparatus for carrying out the mentioned method. As a result, a highly productive coating method that af fords desired coating has been established, wherein two coating rolls are placed in such a way that rotation axes thereof are substantially perpendicular to the ground, and the coating rolls are pressed to a plate while the plate passes between the coating rolls.

That is, the present invention provides a method for coating a plate with a coating solution comprising the steps of: holding the plate in such a manner that surfaces of the plate to be coated is aligned in substantially parallel to a gravity direction; moving the plate to a direction parallel to the surfaces of the plate and at right angle to the gravity direction; passing the plate between two coating rolls to which the coating solution is applied, which rotate in contact with the plate to the same direction as that of the plate, and which rotation axes are substantially perpendicular to a moving direction of the plate and to normal direction of the surfaces of the plate; and forming a film of the coating solution on at least one surface of the plate.

In addition, the present invention provides an apparatus for coating a plate with a coating solution comprising: a means for holding and carrying the plate in such a manner that surfaces of the plate to be coated is aligned substantially parallel to a gravity direction, and for moving the plate to a direction parallel to the surface of the plate and at right angle to the gravity direction; two coating rolls placed with such amount of a clearance therebetween that allowing the plate to pass between the coating rolls, which rotate in contact with the surfaces of the plate to the same direction as that of the plate, and which rotation axes are substantially perpendicular to a moving direction of the plate and to normal direction of the surfaces of the plate; and a means for supplying the coating solution to the coating rolls for supplying the coating solution on the surfaces of the coating rolls.

BRIEF DESCRIPTION OF THE DRAWINGS

FIG. 1(A) is a perspective view thereof, while

FIG. 2(A) is a front view thereof, while

FIG. 3(A) is a front view thereof, while

FIG. 4(A) is a front view thereof, while

DETAILED DESCRIPTION OF THE PREFERRED EMBODIMENTS

Figure 1:
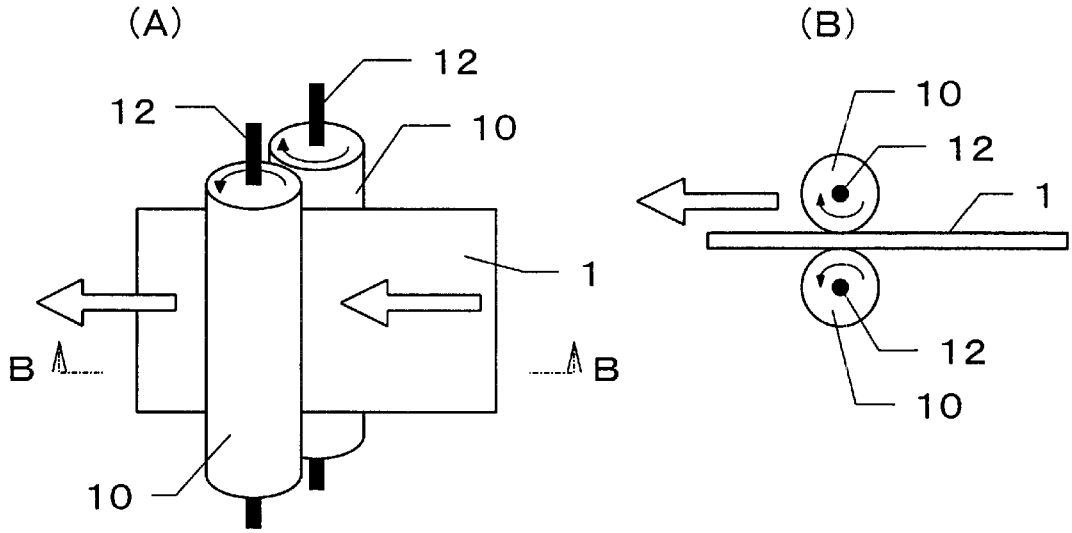
FIGS. 1(A) and (B) are schematic diagrams showing a state wherein a plate is being coated according to the present invention.
FIG. 1(B) is a cross-sectional side view taken along the line B—B of FIG. 1(A).

The present invention is explained in further details referring to the attached drawings as below:

According to the invention, a plate 1 is suspended in such a way that the surface thereof becomes substantially parallel to the gravity direction, and passes between two coating rolls 10, 10 which rotation axes 12, 12 is substantially parallel to the gravity direction, in contact with both rolls 10, 10 as shown in FIG. 1. As a result, a coating solution applied in advance to the surfaces of the coating rolls 10, 10 is coated on the surfaces of the plate 1. Rotation axes 12, 12 of the coating rolls 10, 10 can be expressed as substantially perpendicular to a moving direction of the plate 1 shown by a white arrow in FIG. 1, and to a normal direction of surface 2 to be coated shown by a black arrow in FIG. 2(B). Accordingly, the present invention discloses a method for coating wherein the plate 1 is placed vertically and coating is performed while moving the plate 1 in a horizontal direction parallel to surface 2 to be coated.

The plate 1 is preferable in a cut sheet form, and nature thereof is not specifically limited, while for instance sheet glass or molded resin products are typically employed. Molded resin products include,(meth)acrylic resin, polycarbonate resin, cellulose resin, polystyrene resin, styrene-(meth)acrylic copolymer resin, etc.

Figure 2:
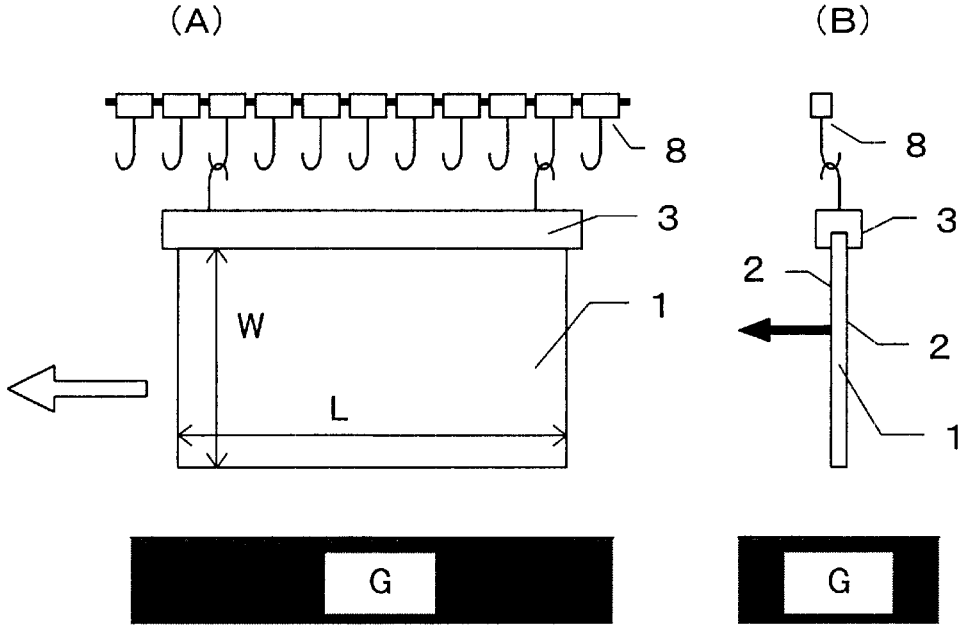
FIGS. 2(A) and (B) are schematic diagrams showing an example of a state wherein a plate is held.
FIG. 2(B) is a side view thereof.

A dimension of the plate 1 is not specifically limited, while preferable dimensional range thereof is about 300 mm to about 2,000 mm in width, about 500 mm to about 4,000 mm in length and about 0.5 mm to about 20 mm in thickness. Referring to the above-described dimension, longer side of rectangle is defined as length L and shorter side as width W as shown in FIG. 2 (A). Among the four sides of the plate 1, at least one side is fixed and held. FIG. 2 shows a state wherein the upper side (of lengthwise direction) of the plate 1 is fixed by fixing frame 3, while it is also possible to fix a side of width. The plate 1 is placed so that normal line of surface 2 to be coated shown by the black arrow in FIG. 2(B) is placed parallel to the ground G.

Figure 3:
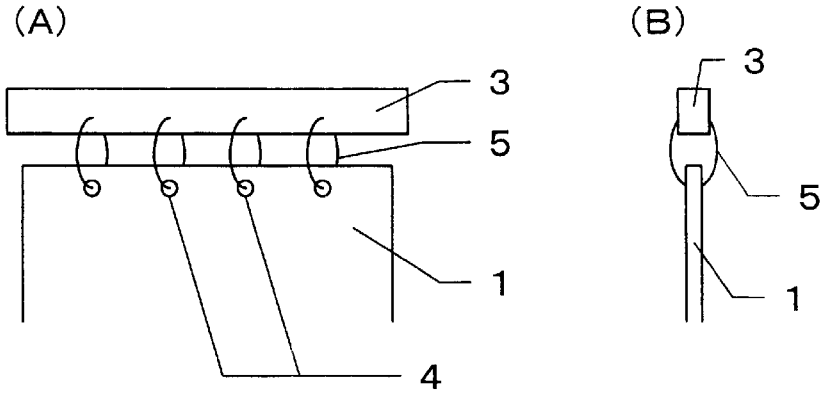
FIGS. 3(A) and (B) are schematic diagrams showing means for holding a plate.
FIG. 3(B) is a side view thereof.
Figure 4:
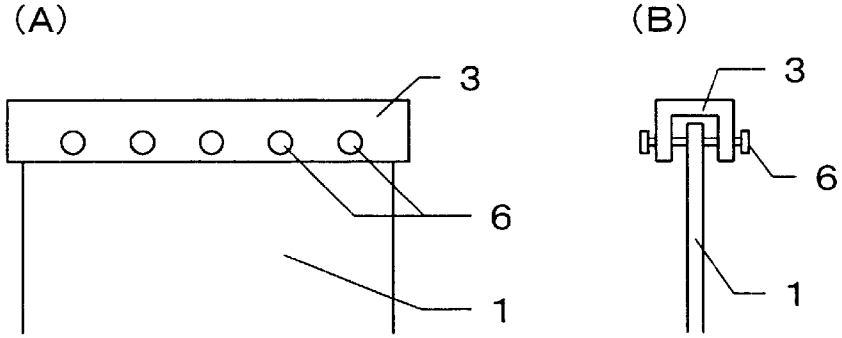
FIGS. 4(A) and (B) are schematic diagrams showing another means for holding a plate.
FIG. 4(B) is a side view thereof.

A method for fixing the plate 1 is not specifically limited, while it is preferable to make a plurality of holes 4 near a side edge to be fixed and to pass hang-up apparatus 5 made of string or wire through holes 4, thus to suspend the plate 1 as shown in FIG. 3, or to use a means 6 for holding such as vise or fixing screws as FIG. 4. Upper side of the plate 1 of FIGS. 2 to 4 held by fixing a means usually passes above the area between two coating rolls 10, 10 so that the coating solution is not applied to the portion held by fixing means, however the fixing means is omitted in other drawings. Also, the upper side, where the coating solution is not applied and coated films is not formed, is usually cut off after completion of coating process.

Now, the plate 1 fixed is moved horizontally at a constant speed. A moving direction of the plate 1 is perpendicular both to a normal direction of coating surface 2 and to the ground G as shown by the white arrow in FIGS. 1 and 2, in other words parallel to the coating surface 2 and at right angle to the gravity direction. As shown in FIG. 2, it is preferable to connect a fixing frame 3 with a means for carrying such as conveyor 8, for moving the plate 1. A moving speed of the plate 1 is not specifically limited, while a range of about 0.5 meters per minute to about 20 meters per minute is preferable. If moving speed is too slow production efficiency is lowered, on the other hand too fast moving speed may cause an irregular coating surface.

On the plate 1, coated films are formed when contacted by the coating rolls 10 to which the coating solution is adhered, as shown in FIG. 1. A size of the coating roll 10 is to be determined according to a dimension of the plate 1, and it is preferable to employ such rolls that are about 10 mm to about 1,000 mm in length, which is longer than the width (to vertical direction) of the plate 1. A diameter of the coating roll 10 is not specifically limited either, while a range of about 50 mm to about 500 mm is preferable.

Materials of the coating roll 10 are not specifically limited, while generally such materials that are resistant to a coating solution are employed. It is preferable that the surface of the coating roll 10 comprises an elastic material such as rubber or resin, for increased contact tightness with the plate 1. A type of rubber or resin for the surface of the coating roll 10 is to be selected from among those materials resistant to the coating solution. For instance, in case of a coating solution contains an organic solvent, either of butyl rubber, ethylene-propylene rubber, nitrile rubber, styrene-butadiene rubber, silicon rubber, urethane resin, resin containing fluorine, etc. may be selected depending on nature of the solvent. A thickness of elastic material to be formed on the surface of the coating roll 10 is not specifically limited, while a thickness of about 3 mm to about 50 mm is typically employed. Also, it is preferable that the elastic material has a hardness of about 20 to about 80 under Schedule A of Spring Hardness Test according to JIS K6301.

For the purpose of coating both surfaces of the plate 1, two coating rolls 10, 10 are placed with such amount of a clearance between each other that allows the plate 1 to pass in contact with surfaces of coating rolls 10, 10 as shown in FIG. 1. The clearance between coating rolls 10, 10 varies depending on nature of material thereof, while it is preferable to make a clearance of about 20% to about 100% of the thickness of the plate 1 in unloaded state (when the plate 1 is not engaged between coating rolls 10, 10), in case where the surface of the coating roll 10 comprises the elastic material. Two coating rolls 10, 10 can either be respectively provided with a means for driving such as a motor for rotating, or be made to rotate freely along with movement of the plate 1, without a means for driving. In case where a means for driving is to be provided, the means must be designed so that the rotating direction of two coating rolls 10, 10 becomes opposite to each other, since the coating rolls 10, 10 respectively rotate to the same direction as the moving direction of the plate 1. A rotating speed of coating roll 10 is not specifically limited but is determined depending on a roll diameter and a moving speed of the plate 1, while in general a range of about 0.3 rpm to about 150 rpm is preferable. Especially when the surface of the coating roll 10 comprises an elastic material such as rubber or resin, it is desirable to determine the rotating speed of the coating roll 10 so that it will be synchronized with the moving speed of the plate 1.

Figure 5:
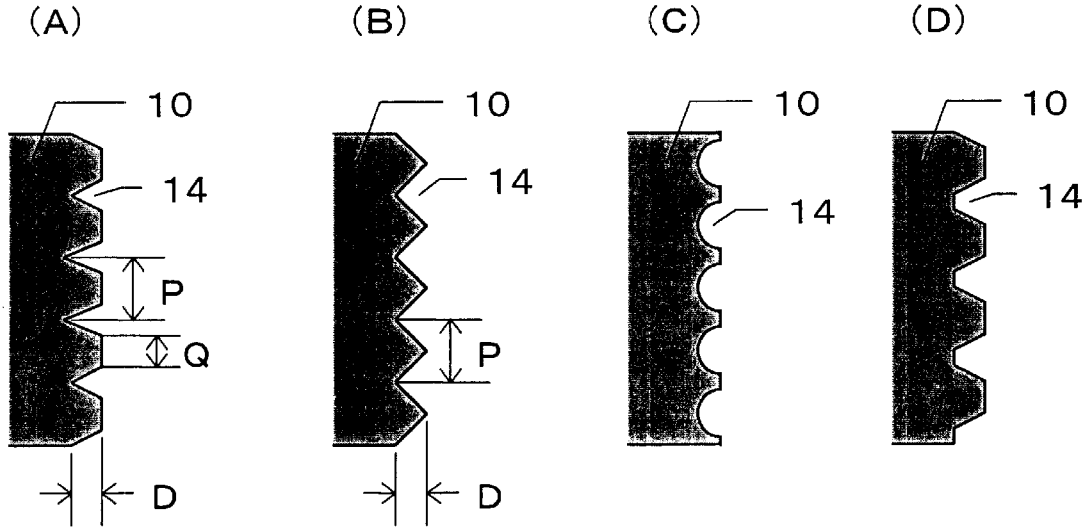
FIGS. 5(A) to (D) are enlarged cross-sectional views conceptually showing a portion of several cross-sectional shapes of grooves to be formed on the surfaces of the coating rolls.
Figure 6:
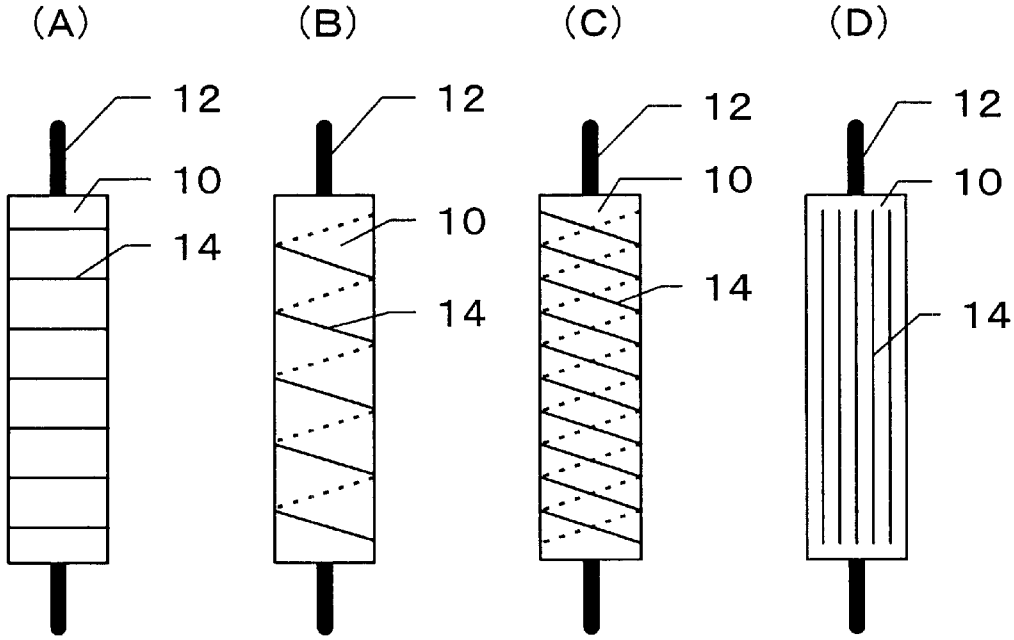
FIGS. 6(A) to (D) are front views conceptually showing several shapes of grooves formed on the surfaces of the coating rolls.

The surface of the coating roll 10 can either be flat or uneven. Also, fine grooves 14 can be formed on the surface of the coating roll 10 for adjusting a coated film thickness to a desired level, as shown in FIG. 5 and 6. Examples of groove shape formed on the surface of the coating roll 10 include V-shape as FIGS. 5(A) and (B), semicircle as FIG. 5(C), or trapezoid as FIG. 5(D), etc. Fine grooves 14 can be formed in plural concentric circles on the coating roll 10 as shown in FIG. 6(A), or in singular or plural spirals as FIGS. 6(B) and (C), or further in plural vertical lines as FIG. 6(D). A depth D of the groove formed on the surface of the coating roll 10 is not specifically limited, while a range of about 0.01 mm to about 5 mm is preferable. Also, a distance P between center of a groove and that of an adjacent groove (the pitch of grooves) is not specifically limited, while a range of about 0.01 mm to about 5 mm is preferable. A flat area Q can be formed between a groove and an adjacent groove as FIG. 5(A), (C) and (D), while grooves can also be closely formed without a flat area as FIG. 5(B).

It is also possible to form grooves of various depths and/or pitches between upper and lower portion of the surface of the coating roll 10, with an object to obtain a uniform coated film thickness to a vertical direction of the plate 1, or to intentionally vary a coated film thickness of a specific portion. For instance, it is possible to increase coating thickness of a specific portion by forming deeper grooves 14, or grooves 14 of narrower pitch at the corresponding portion of the coating roll 10. In addition, when the depth and pitch of fine grooves 14 are constant all over the coating roll 10, a coated film thickness to a vertical direction of the plate 1 tends to be gradually greater toward the lower portion of the coating roll 10, due to the effect of the gravity. Therefore it is preferable to gradually reduce the depth or gradually increase the pitch of fine grooves 14 toward the lower portion of the coating roll 10, for the purpose of achieving a uniform coated film thickness.

Figure 7:
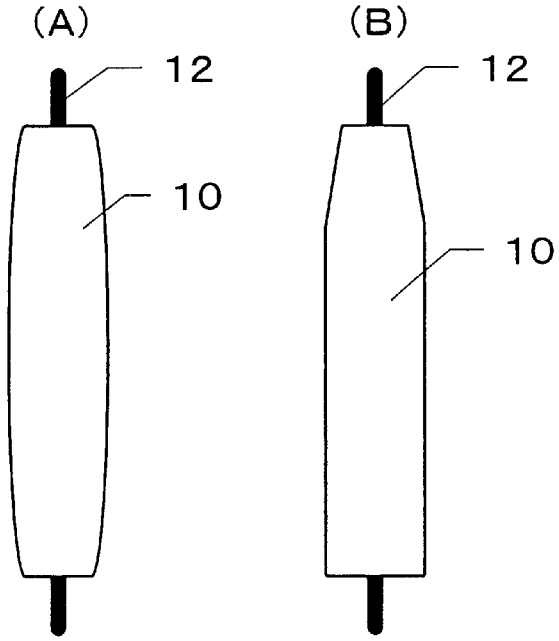
FIGS. 7(A) and (B) are front views conceptually showing examples of variations of cross-sectional diameter from the top to the bottom of the coating rolls.

Across-sectional diameter of coating roll 10 is typically constant from upper to lower portion thereof, while it is effective to vary the diameter from upper to lower portion of the coating roll 10 depending on nature of material to be coated. For instance, the coating roll 10 can be crowned lengthwise to make a diameter of central portion slightly greater than that of end portion as shown in FIG. 7(A), for the purpose of applying constant contacting pressure to the plate 1. It is also possible to make the roll diameter greater or smaller at a specific portion of the coating roll 10, with an object to increase or decrease contacting pressure at the corresponding portion in a vertical direction of the plate 1. Further, it is also possible to taper off the coating roll 10 to slightly reduce the diameter at upper portion thereof, since according to the invention the plate 1 is placed vertically and so coating thickness of upper portion tends to be thinner due to the effect of gravity. In case of varying a cross-sectional diameter of the coating roll 10 from upper to lower portion thereof as described above, it is advantageous that the diameter of the leanest portion of the coating roll 10 exceeds about 90%, preferably about 99%, of the diameter of the thickest portion thereof.

Figure 8:
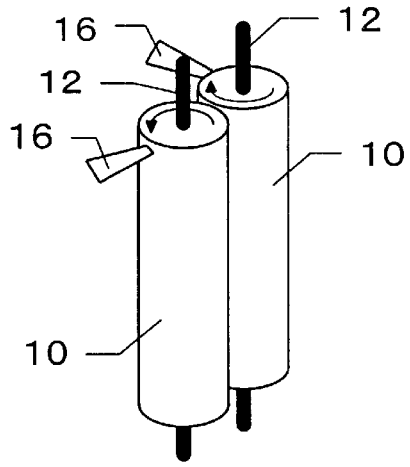
FIG. 8 is a perspective view conceptually showing the coating rolls provided with a means for supplying the coating solution.

A coating solution is to be applied to the coating roll 10. Normally it is desirable that the coating solution is applied all over the coating roll 10 before the coating roll 10 contacts with the plate 1. When applying the coating solution to the coating roll 10 it is desirable that the coating solution fully covers an area that contacts with the plate 1, and for such purpose it is preferable that the coating roll 10 is provided with a means 16 for supplying the coating solution at the top thereof, from which the coating solution is to flow down as shown in FIG. 8. According to FIG. 8, the means 16 for supplying the coating solution comprises a flow nozzle. A quantity of the coating solution to be supplied on the coating roll 10 is not specifically limited as far as the coating solution adheres all over from the top to the bottom of the coating roll 10, while a range of about 0.1 liters per minute to about 2 liters per minute is preferable. The quantity varies depending on a diameter or a length of the coating roll 10.

Figure 9:
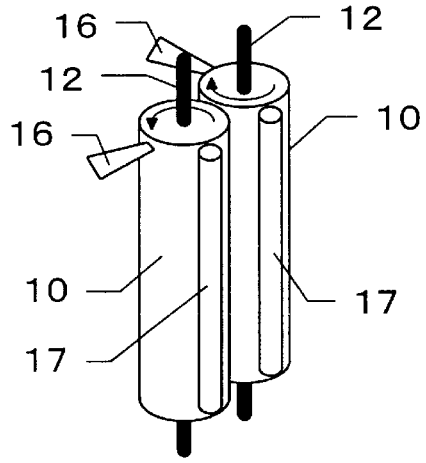
FIG. 9 is a perspective view conceptually showing the coating rolls provided with a means for scraping.
Figure 10:
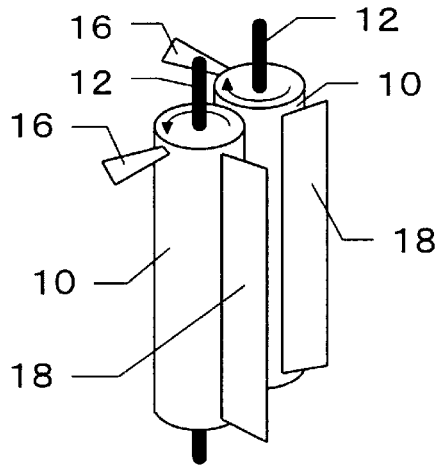
FIG. 10 is a perspective view conceptually showing the coating rolls provided with another means for scraping.

It is also preferable that the coating roll 10 is provided with a means for scraping the surface thereof, for eliminating an excessive coating solution adhered to the coating roll 10, with object to form an even coating solution layer. Such means for scraping may comprise bar, rod, roll or blade made of metal or resin, and be mounted ahead of the aforementioned means 16 for supplying the coating solution to a rotating direction of the coating roll 10, but within an area not contacting with the plate 1. FIG. 9 shows an arrangement wherein doctor bars 17, 17 made of stainless steel rod are placed in such a way that doctor bars 17, 17 contact with the coating rolls 10, 10 at a portion located between the means 16, 16 for supplying the coating solution provided at each of the top portions of the two coating rolls 10, 10 respectively, and a contacting portion of the coating rolls 10, 10 in the respective rotating direction. FIG. 10 shows another arrangement wherein doctor blades 18, 18 made of stainless steel plate are substituted for doctor bars 17, 17 of FIG. 9. As a result of providing such means for scraping, the coating rolls 10, 10 can contact with the plate 1 after a coating solution layer formed on coating rolls 10, 10 has been made even by the means for scraping.

Figure 11:
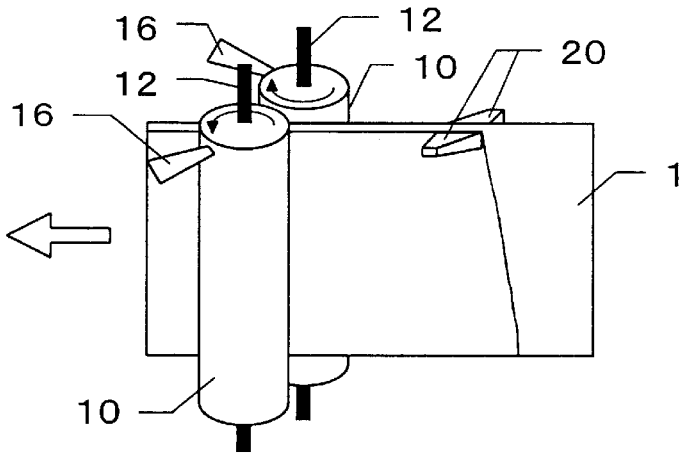
FIG. 11 is aperspective view conceptually showing a state wherein a plate is being coated by the coating rolls of FIG. 8.
Figure 12:
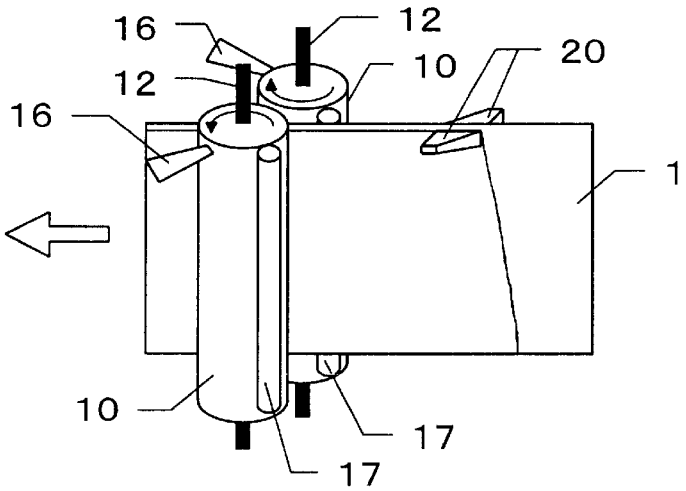
FIG. 12 is a perspective view conceptually showing a state wherein a plate is being coated by the coating rolls of FIG. 9.
Figure 13:
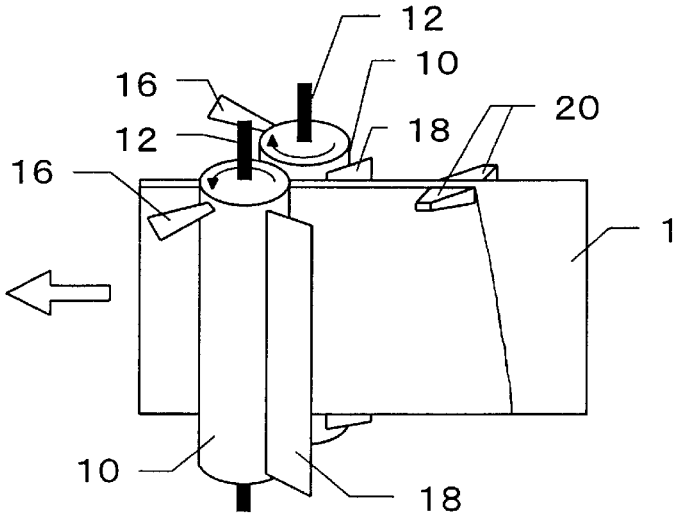
FIG. 13 is a perspective view conceptually showing a state wherein a plate is being coated by the coating rolls of FIG. 10.

Further, it is also possible to form a layer of the coating solution in advance on the surface of the plate 1 by flow coating, before the plate 1 contacts with the coating rolls 10, 10. FIGS. 11 through 13 show schematic views of apparatuses for the mentioned purpose. Specifically, means 20, 20 for supplying the coating solution to the plate is provided for supplying coating solution to a portion of the plate 1 which has not yet been contacted with the coating rolls 10, 10, according to FIG. 11 provided with the means 16, 16 for supplying the coating solution for the coating rolls of FIG. 8, according to FIG. 12 provided with the means 16, 16 for supplying the coating solution to the coating rolls and the doctor bars 17, 17 of FIG. 9, and according to FIG. 13 provided with the means 16, 16 for supplying the coating solution to the coating rolls and the doctor blades 18, 18 of FIG. 10, respectively. The means 20 for supplying the coating solution to the plate 1 comprises a flow nozzle according to the above-described arrangement examples. As a result of forming a coating solution layer on the surface of the plate 1 in advance by flow coating, the plate 1 on which a coating solution layer has been formed is to pass between the coating rolls 10, 10, consequently a result a coated film of desired thickness can be obtained.

A quantity of the coating solution applied to the plate 1 is not specifically limited, while it is preferable to supply about 1 liter per minute to about 5 liters per minute for one side of the plate 1 in case where the coating solution flows down over the plate in a width of about 5 cm to about 10 cm under such arrangements as shown in FIGS. 11 through 13. Such quantity varies depending on the area over which the coating solution is to flow. Performing the flow coating in advance offers an additional advantage that appearance of the coated film can be improved because flow of the coating solution can wash away dust adhered on the surface of the plate 1. Further, the coating rolls 10, 10 can eliminate an excessive coating solution leaving a sufficient quantity to form a desired coated film even when an excessive coating solution is applied on the surface of the plate 1. As a result it is possible not only to eliminate dust on the plate 1, but also to minimize influence of dust that may exist on the coating rolls 10, 10.

Figure 14:
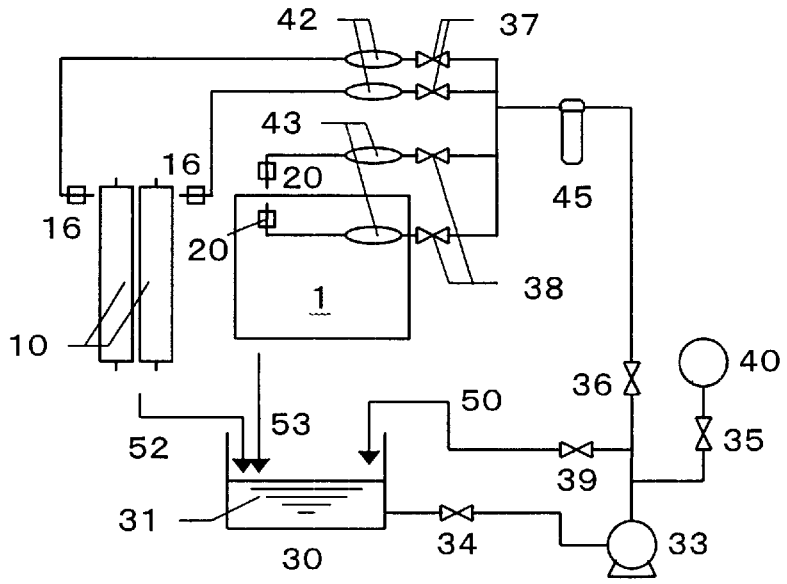
FIG. 14 is a flow chart showing an arrangement for circulating a coating solution according to the present invention.

According to the present invention, it is preferable that a means for circulating such as a pump is provided for a circulating coating solution. Referring to a flow chart of FIG. 14, it is preferable that a coating solution 31 is aspirated by a pump 33 from a tank 30 which stores the coating solution 31 through a valve 34, and then branched so that the coating solution is supplied to the respective tops of the coating rolls 10, 10 through the means 16, 16 for supplying the coating solution to the coating rolls 10, 10. Also, for the purpose of supplying the coating solution to the surface of the plate 1, it is preferable to provide a branch piping so that the coating solution 31 aspirated by the pump 33 flows to both surfaces of the plate 1 and to the coating rolls 10, 10 respectively. According to FIG. 14, a pressure gauge 40 detects pressure of the coating solution aspirated by the pump 33 through a valve 35, and the coating solution is branched after flowing through a valve 36 to be led to the means 16, 16 for supplying the coating solution to the coating rolls 10, 10 via valves 37, 37 and flow meters 42, 42, and to the means 20, 20 for supplying the coating solution to the plate 1 via valves 38, 38 and flow meters 43, 43 respectively. It is desirable to provide a pressure gauge 40 for detecting abnormality such as clogging of pipe.

It is preferable to remove dust that may be contained in the coating solution, purifying the coating solution through a filter immediately after pumping up or before supplying to the coating rolls 10, 10 or to the plate 1. According to FIG. 14, a filter 45 is provided for filtrating the coating solution before a coating solution route is branched to the coating rolls and to the plate 1. Also, it is preferable that out of the coating solution aspirated by the pump 33, a remaining portion after a required quantity has flown into a supply route to the coating rolls 10, 10 and the plate 1 is returned to the tank 30 through a by-pass 50 provided with a valve 39. Further it is preferable to collect a surplus coating solution after flowing over the coating rolls 10, 10 and if necessary over the plate 1, and to return to the tank 30. According to FIG. 14, the surplus coating solution after flowing to the coating rolls 10, 10 is to be returned to the tank 30 through a collecting route 52, while the surplus coating solution after flowing to the plate 1 through a collecting route 53.

According to the foregoing method and arrangement, a film of the coating solution is formed on the plate 1. The plate 1 is then dried to remove solvent contained in the coating solution, and is obtained a finished product. If necessary, after solvent is removed the plate 1 may further be heated or irradiated by activated radial rays such as ultraviolet rays or electronic beams, to cure the coated film by cross-linking or polymerization.

The method and apparatus according to the present invention is suitable for coating both surfaces of a plate, while it is also possible to coat only one side of a plate if so desired. For instance, one side application can be performed through the steps of: placing a sheet of a plate over another and fixing end portion thereof using a double-sided adhesive tape to tightly adhere both plates so that a coating solution does not enter between the plates; letting the combined plates pass between two coating rolls placed vertically according to the present invention to apply the coating solution to the plates; and separating the two plates after coating, or after necessary post treatment. The above-described method offers better productivity than prior arts since two plates can be coated at a time.

EXAMPLES

Hereunder, further details of the present invention are disclosed according to the following examples, however it is to be understood that the invention is not limited to the following examples.

Percentage expressions in the examples are by weight unless otherwise noted.

All hardness values are based on Schedule A of Spring Hardness Test according to JIS K6301.

EXAMPLE 1

A polymethylmethacrylate resin plate ("Sumipex E 000" manufactured by Sumitomo Chemical Co., Ltd.) of 1,000 mm in width, 2,000 mm in length and 2 mm in thickness was used as a plate 1 and suspended with its lengthwise side up and thereby fixed by hangers with clamps. The mentioned hangers were connected to a conveyor, which carried the plate 1 at a speed of 3.0 meters per minute to a lengthwise direction thereof. As a coating solution 31, a solution comprising a hard coat agent ("NK Hard M-101" manufactured by Shin Nakamura Kagaku Kogyo; containing 80% urethane acrylate compound) and ethyleneglycol monoethylether was used, in which a concentration of the hard coat agent is 40%.

Figure 15:
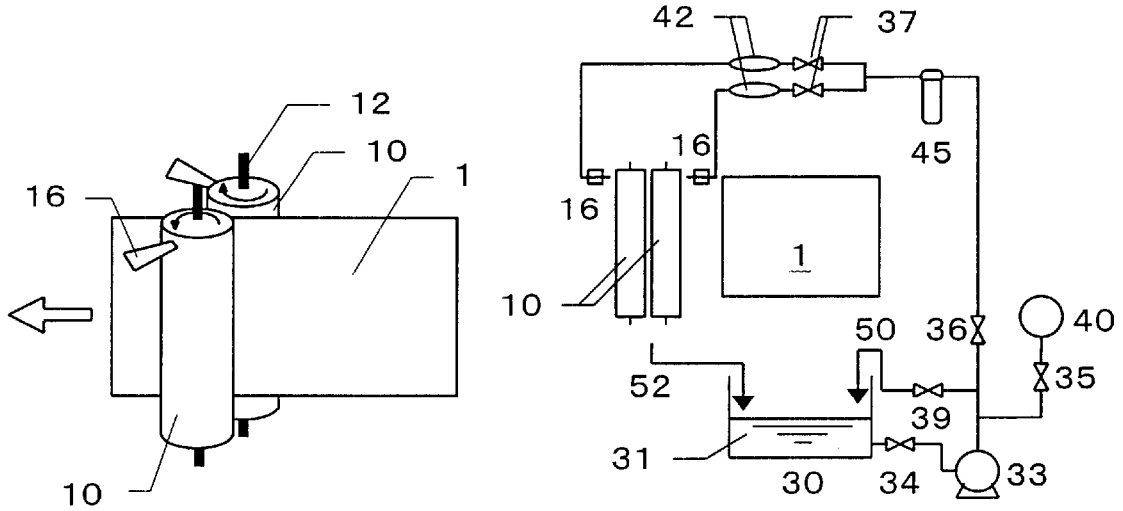
FIG. 15 includes an outline of a coating apparatus and a flow chart showing an arrangement for circulating coating solution used in Example 1 of the present invention.

FIG. 15 shows a perspective view of a coating apparatus and a flow chart of coating solution circulation used in this Example 1. Reference numerals in FIG. 15 stand for the same components as in FIGS. 1, 8 and 14. Two rolls of 1,350 mm in length and 150 mm in diameter, which have a surface layer of 10 mm in thickness and are made of a butyl rubber of hardness of 40, were used as the coating rolls 10, 10. On the surface of the coating rolls V-shaped grooves (groove angle 90°) of a depth of 0.15 mm in a pitch of 0.5 mm, parallel with moving direction of the plate are formed. Configuration of these grooves substantially corresponds to those shown in FIGS. 5(A) and 6(A). A quantity of the coating solution supplied to two coating rolls 10, 10 was 0.5 liters per minute, per roll. A rotational circumferential speed was 3.0 meters per minute, and a clearance between the two rolls was 1.0 mm. Time required for coating one sheet of the plate was substantially 40 seconds. After coating, the coated plate was dried for 10 minutes at 40° C. and irradiated by ultraviolet rays at a rate of 500 mJ/cm$^2$, for curing the coated film.

A thickness of the cured film was measured at three points, i.e. upper (substantially 250 mm from the upper end of the plate), central (substantially 500 mm from the upper end) and lower (substantially 750 mm from the upper end) points, using a microscopic coating thickness meter "MS-2000" (manufactured by Otsuka Denshi Co., Ltd.), and the results are shown in Table 1.

EXAMPLE 2

Figure 16:
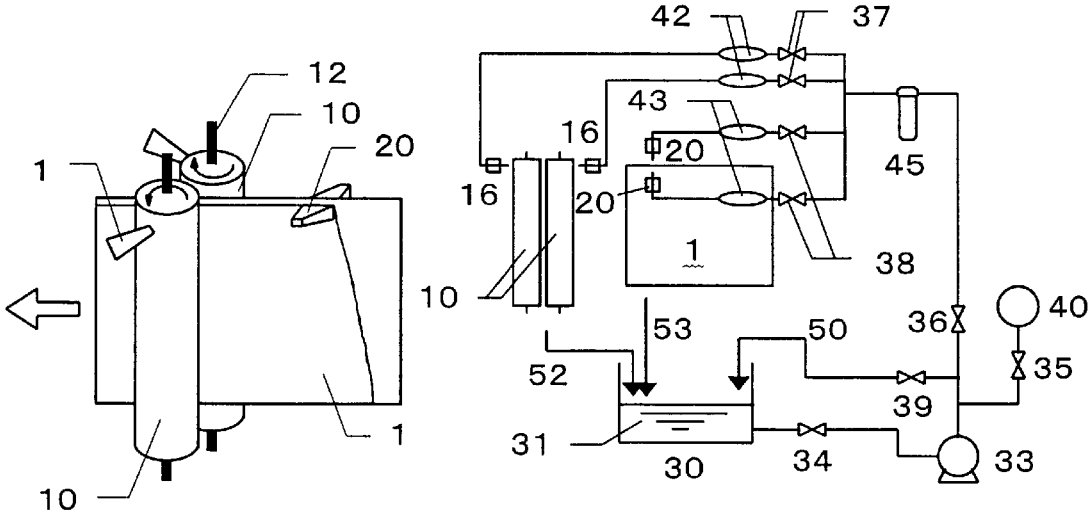
FIG. 16 includes an outline of a coating apparatus and a flow chart showing an arrangement for circulating coating solution used in Examples 2 and 5 of the present invention.

A similar coating process as the Example 1 was performed, except that the coating solution was first flow-coated on both surfaces of the plate 1 at a rate of 3.0 liters per minute for one side of the plate 1, before the plate 1 passed between the coating rolls 10,10. FIG. 16 shows a perspective view of the coating apparatus and a flow chart of coating solution circulation according to this Example 2. Numerals in FIG. 16 stand for the same components as in FIGS. 11 and 14. A thickness of the cured coated film was measured in the same way as Example 1, and the results are shown in Table 1.

Comparative Example 1

The plate was coated using a dip coat method as a method of coating.

The plate is the same as the Example 1, but of a dimension of 1,000 mm in width and 1,000 mm in length, was coated by a dip coating method. A coating solution used was also the same as the Example 1. A moving speed of the plate for coating was 0.5 meters per minute for both dipping in and drawing out, and drawing out was started 10 seconds after dipping was completed. A time required for coating one sheet of the plate was substantially 4 minutes and 10 seconds. A thickness of the cured coat film was measured in the same way as the Example 1, and the results are shown in Table 1.

Comparative Example 2

Solely flow coating was applied to the plate in a similar way as the Example 2, except that the clearance of two coating rolls was 20 mm so that the plate should not contact with the coating rolls while passing through the gaps between the coating rolls. A thickness of the cured coated film was measured in the same way as the Example 1, and the results are shown in Table 1.

EXAMPLE 3

Figure 17:
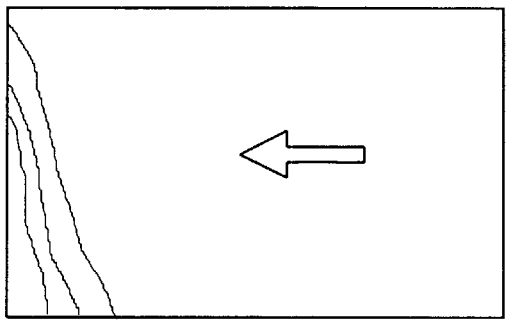
FIG. 17 is a schematic view showing a state of a surface of a coated plate resulting from Example 3 of the present invention.

A similar coating method as the Example 2 was performed, except a coating solution comprising 53.6 parts by weight of a curable coating composite material containing a electro-conductive particles ("Sumisefine R-311" manufactured by Sumitomo Osaka Cement Co., Ltd.), 6.9 parts by weight of dipentaerythritol hexacrylate ("NK Ester A-9530" manufactured by Shin Nakamura Kagaku Kogyo), 10.8 parts by weight of methylethyl ketone and 24.2 parts by weight of diacetonealcohol was used in place of the coating solution used in the Example 1. On the coated plate, line pattern as shown in FIG. 17 was faintly recognized in the proximity of a portion that first contacted with the coating rolls, i.e. at the front end to moving direction of the plate. A thickness of the cured coated film was measured in the same manner as the Example 1, and the results are shown in Table 1.

EXAMPLE 4

A similar coating method as the Example 3 was performed, except that as shown in FIG. 12, doctor rods of stainless steel 17, 17 with 10 mm in diameter and 1,200 mm in length were provided ahead of a coating solution supplying nozzles 16, 16 located at the top of coating rolls 10, 10 along their rotating direction but within an area where coating rolls 10, 10 are not contacting with the plate 1, so that to avoid adherence of an excessive paint on the coating rolls 10, 10. On the coated plate, line pattern, which was seen in the Example 3, was not observed. A thickness of the cured coated film was measured in the same manner as the Example 1, and the results are shown in Table 1.

TABLE 1

| | Thickness of cured coated film | | | |
|---|---|---|---|---|
| Example No. | Upper portion | Central portion | Lower portion | Time required for coating |
| Example 1 | 3.7 μm | 3.9 μm | 3.9 μm | 40 seconds |
| Example 2 | 4.2 μm | 4.5 μm | 4.4 μm | 40 seconds |
| Comparative example 1 | 3.8 μm | 3.4 μm | 3.6 μm | 250 seconds |
| Comparative example 2 | 2.4 μm | 4.6 μm | 6.7 μm | 40 seconds |
| Example 3 | 3.8 μm | 4.0 μm | 4.1 μm | 40 seconds |
| Example 4 | 3.6 μm | 3.8 μm | 3.8 μm | 40 seconds |

EXAMPLE 5

An antistatic hard coated acrylic resin plate ("Sumielec FT 000" manufactured by Sumitomo Chemical Co., Ltd.) of 1,000 mm in width, 2,000 mm in length and 2 mm in thickness was used as a plate and suspended with its lengthwise side up and thereby fixed by hangers with clamps. The hangers were connected to a conveyor, which carried the plate at a speed of 3.0 meters per minute to the lengthwise direction of the plate. As a coating solution, an antireflection coating solution "Opstar JM5022" (manufactured by JSR; containing 3% of fluorine contained resin) diluted to 15% of concentration by methylisobutyl ketone was used.

Two rolls of 1,350 mm in length and 150 mm in diameter having a surface layer of a 10 mm in thickness made of ethylene-propylene rubber with a hardness of 60 were employed as the coating rolls 10. On the surface of the coating rolls there were provided V-shaped grooves (groove angle 90°) having a depth of 0.15 mm in a pitch of 0.5 mm, being in a parallel alignment with the moving direction of the plate. A quantity of the coating solution supplied to two coating rolls 10, 10 was 0.5 liters per minute, respectively. A rotational circumferential speed was 3.0 meters per minute, and a clearance between the rolls was 1.0 mm. Also, the coating solution was first flow-coated on both surfaces of the plate 1 at a rate of 3.0 liters per minute for one side of the plate 1, before the plate 1 passed between the coating rolls 10, 10. A schematic view of a coating apparatus and a flow chart of coating solution circulation according to this Example 5 are similar to FIG. 16. After coating, the coated plate was dried for 10 minutes at 40° C. and irradiated by ultraviolet rays at a rate of 500 mJ/cm$^2$, for curing the coated film.

A thickness of cured film on the plate was calculated based on the absolute mirror reflection spectrum of incident angle of 5 degrees, measured by a spectrophotometer "UV-3100PC" (manufactured by Shimadzu Corporation) after applying black paint to the back side of the coated plate. A thickness d(nm) of the coated film was calculated from the wavelength (λmin) at which reflectance becomes the minimum, according to the following formula:

$$d=\lambda\min/4n$$

wherein n is a refractive index of the cured film(1.437).

Figure 18:
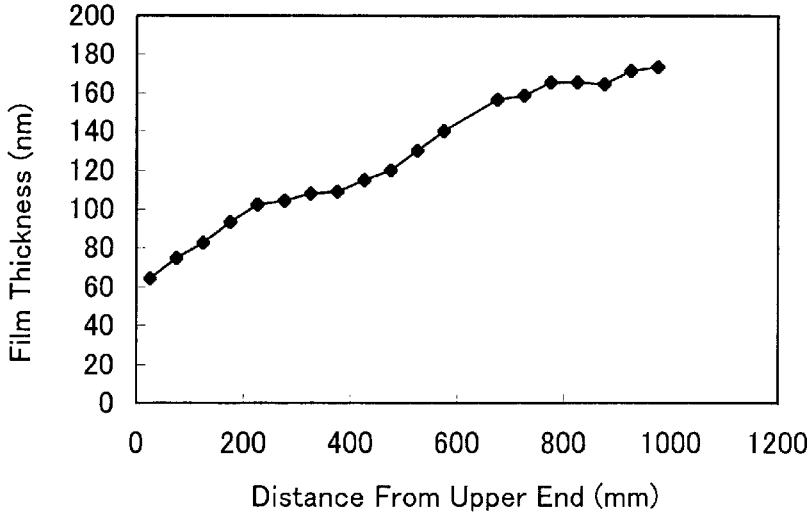
FIG. 18 is a graph showing a distribution of a thickness of a coated film resulting from Example 5 of the present invention.

A thickness of the cured coated film was measured at an interval of 50 mm to the width direction of the plate(vertical direction while being carried), and the results are shown in FIG. 18.

EXAMPLE 6

Figure 19:
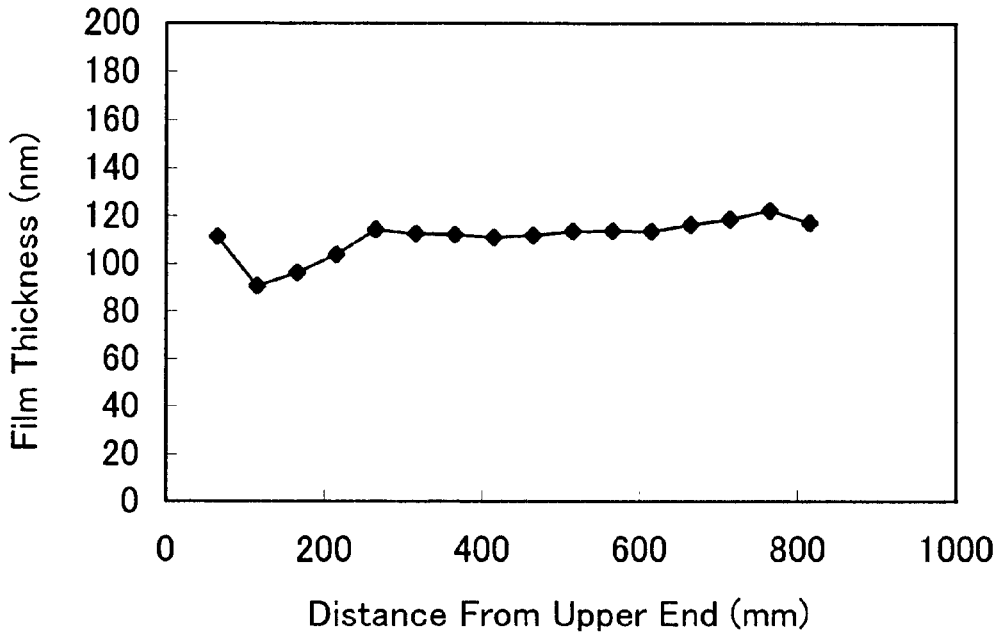
FIG. 19 is a graph showing a distribution of a thickness of a coated film resulting from Example 6 of the present invention.

A similar coating method to as that in the Example 5 was performed, except that two coating rolls were respectively tapered in an area down to 400 mm from the upper end, so that diameter at the upper most portion was 149 mm. The coating rolls were provided with a surface layer of 10 mm in thickness, made of ethylene-propylene rubber having hardness of 60 were employed as the coating rolls 10 and having V-shaped grooves (groove angle 90°) with a depth of 0.15 mm in a pitch of 0.5 mm, parallel to the moving direction of the plate. A thickness of the cured coated film was measured in the same manner as the Example 5, and the results are shown in FIG. 19.

EXAMPLE 7

Figure 20:
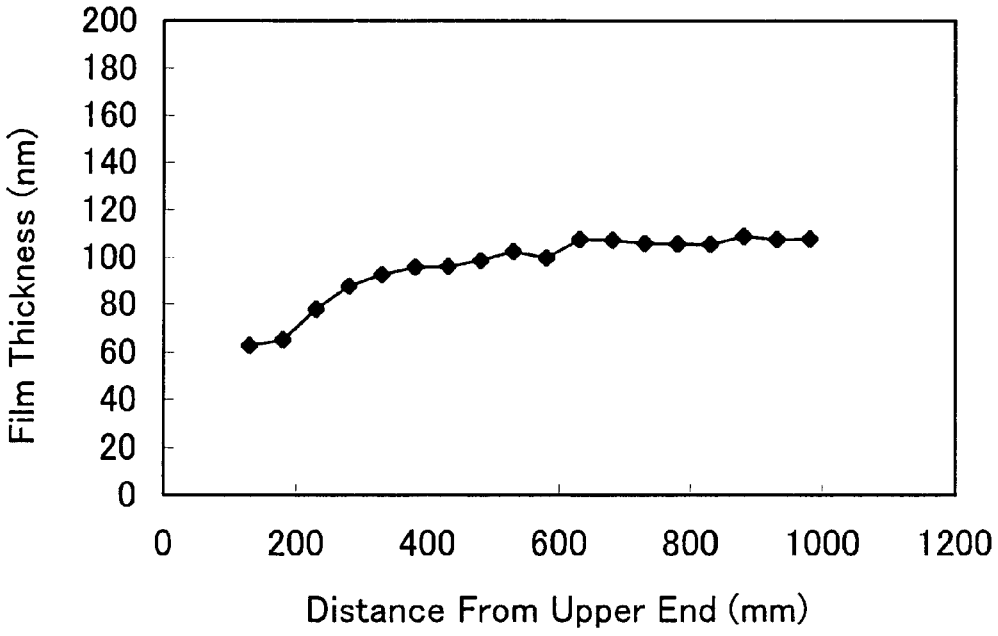
FIG. 20 is a graph showing a distribution of a thickness of a coated film resulting from Example 7 of the present invention.

A similar coating method as that in the Example 5 was performed, except that the coating rolls 10 were provided with a surface layer of 10 mm in thickness, made of ethylene-propylene rubber of a hardness of 60 and being provided with grooves which were aligned in parallel with the moving direction of the plate in a pitch of 0.5 mm at the top, but the pitch of grooves was gradually expanded downwardly reaching to 2.0 mm at the bottom. A thickness of the cured coated film was measured in the same manner as the Example 5, and the results are shown in FIG. 20.

EXAMPLE 8

Figure 21:
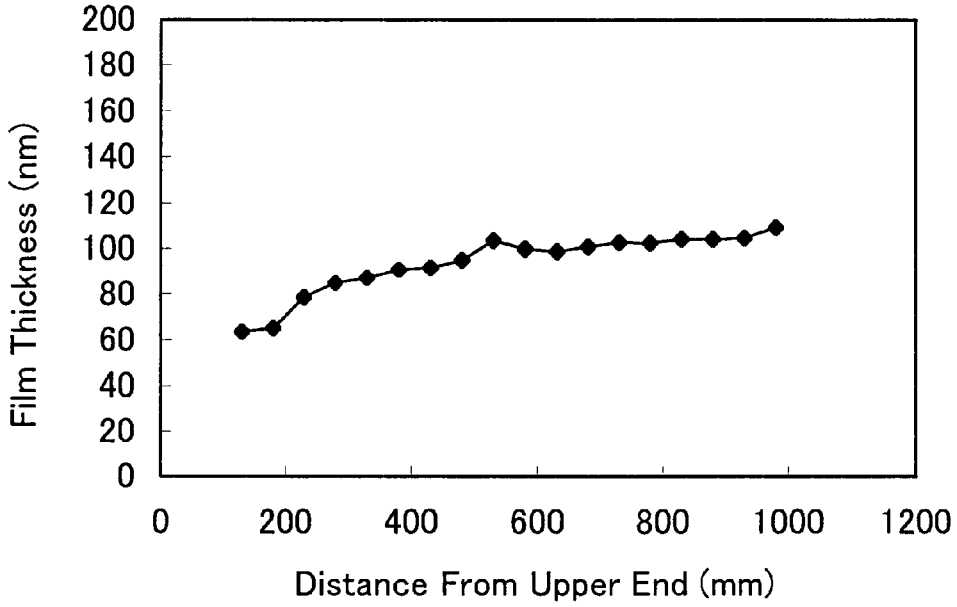
FIG. 21 i s a graph showing a distribution of a thickness of a coated film resulting from Example 8 of the present invention.

A similar coating method as that in the Example 5 was performed, except that the coating rolls 10 having surface layer of about 10 mm in thickness, made of ethylene propylene rubber of a hardness of 60 and being provided with grooves of 0.15 mm depth at the top and aligned in parallel to a moving direction of the plate, but the depth of grooves was gradually reduced downwardly reaching to be 0.05 mm at the bottom. A thickness of the cured coated film was measured in the same manner as the Example 5, and the results are shown in FIG. 21.

EXAMPLE 9

Figure 22:
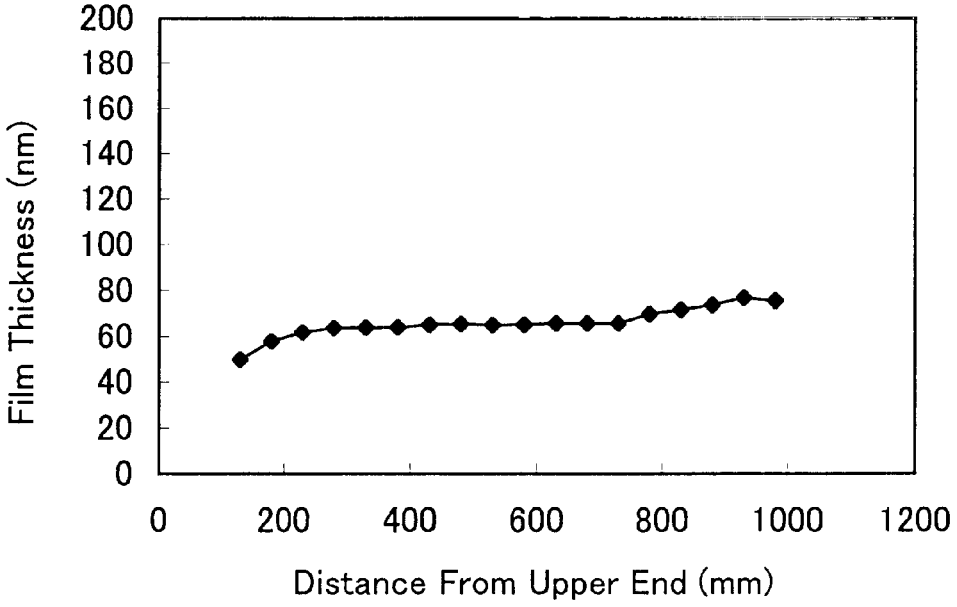
FIG. 22 is a graph showing a distribution of a thickness of a coated film resulting from Example 9 of the present invention.

A similar coating method as that in the Example 8 was performed, except that, as shown in FIG. 10, doctor blades 18, 18 with 50 mm in width, 1,200 mm in length and 1 mm in thickness made of stainless steel were provided ahead of coating solution supplying nozzles 16, 16 at the top of the coating rolls 10, 10 along the rotating direction but within an area where the coating rolls 10, 10 were not contacting with the plate 1, for so that adherence of an excessive coating solution on the coating rolls 10, 10, could be removed and further that flow coating on the plate before contacting with the coating rolls was omitted. A thickness of the cured coated film was measured in the same manner as in the Example 5, and the results are shown in FIG. 22.

According to a method of the present invention, simultaneous coating on both surfaces of a plate can be executed at a faster coating speed, and a coated film of a superior uniformity in thickness and of a better appearance can be obtained. Also, according to the method of the present invention a coating application can be easily executed without alternating a coating apparatus, to various plates of different vertical dimension (along the gravity direction). Further, the present invention offers a vertical type coating apparatus, which is appropriate for the foregoing coating method.

What is claimed is:

1. A method for coating a plate with a coating solution comprising the steps of:

holding the plate in such a manner that surfaces of the plate are aligned substantially parallel to a gravity direction;

forming a coating solution layer on surfaces of the plate by causing the coating solution to flow down in advance over the surfaces of the plate;

moving the plate in a direction parallel to the surfaces of the plate and at a right angle to the gravity direction;

passing the plate between two coating rolls to which the coating solution is applied, which rolls rotate in the same direction as that of the plate while being in contact with the surfaces of the plate, and which rotation axes are substantially perpendicular to a moving direction of the plate and to normal direction of the surfaces of the plate; and forming a film of the coating solution on at least one surface of the plate.

2. The method for coating a plate with a coating solution according to claim 1, wherein the plate is in a cut sheet form.

3. The method for coating a plate with a coating solution according to claim 1, further comprising steps of: scraping a surplus coating solution on the coating rolls and making a substantially uniform layer of the coating solution on the coating rolls after applying the coating solution to the surfaces of the coating rolls.

* * * * *